US006348020B2

(12) United States Patent
Hodjat et al.

(10) Patent No.: US 6,348,020 B2
(45) **Date of Patent: *Feb. 19, 2002**

(54) INTERNAL SPUN HUB AND METHOD OF MAKING SAME

(75) Inventors: Yahya Hodjat, Oxford, MI (US); Marc R. Cadarette, London; John P. Roes, Strathroy, both of (CA)

(73) Assignee: The Gates Corporation, Denver, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/525,618

(22) Filed: Mar. 14, 2000

Related U.S. Application Data

(60) Provisional application No. 60/160,253, filed on Oct. 19, 1999.

(51) Int. Cl.[7] ..... F16H 55/36; B21D 53/26

(52) U.S. Cl. ..... 474/166; 474/170; 72/82; 29/894.362

(58) Field of Search ..... 474/166, 168, 474/169, 170; 29/892, 892.2, 892.3, 894.36, 894.362; 72/71, 82

(56) References Cited

U.S. PATENT DOCUMENTS

| | | | | | |
|---|---|---|---|---|---|
| 3,080,644 | A | * | 3/1963 | Previte et al. | 29/892.2 |
| 3,758,930 | A | * | 9/1973 | Frost et al. | 29/892.2 |
| 3,893,818 | A | * | 7/1975 | Mickus | 29/892.2 |
| 4,050,321 | A | * | 9/1977 | Kraft | 474/170 |
| 4,824,422 | A | | 4/1989 | Jocic | 474/170 |
| 5,441,456 | A | | 8/1995 | Watanabe et al. | 474/94 |
| 5,619,879 | A | * | 4/1997 | Friese | 72/82 |
| 5,823,904 | A | | 10/1998 | Hodjat et al. | 474/170 |
| 5,947,853 | A | | 9/1999 | Hodjat et al. | 474/166 |
| 5,951,422 | A | | 9/1999 | Roes et al. | 474/94 |
| 5,979,203 | A | * | 11/1999 | Radocaj | 72/71 |
| 5,987,952 | A | * | 11/1999 | Kutzscher et al. | 72/71 |

FOREIGN PATENT DOCUMENTS

| | | | | |
|---|---|---|---|---|
| DE | 44 44 526 C1 | | 11/1995 | B21D/22/14 |
| JP | 3-20154 A | * | 1/1991 | 474/166 |

* cited by examiner

*Primary Examiner*—Richard M. Lorence
(74) *Attorney, Agent, or Firm*—J. A. Thurnau, Esq.; C. H. Castleman, Esq.; S. G. Austin, Esq.

(57) ABSTRACT

A hub having a bore, in accordance with the present invention, is spun-roll formed of a portion of an annular sheet metal disc. The hub is formed by radially displacing a portion of the annular sheet disc outward from the bore. The so formed hub that is integral to the annular sheet metal disc forms a web having a thickness equivalent to or not less than a thickness of the annular sheet metal disc before formation of the hub. The web may be used to spun-roll form a rim having a belt receiving portion and as such a one-piece spun roll formed pulley. The web may also be used to interconnect to a rim having a belt receiving portion as a separate piece from the hub and web.

During the spinning process, a shaping roller is pressed against a bore of an annular sheet metal disc which is being rotated simultaneously. The shaping roller is moved progressively, radially outward, with or without axial oscillation, against the bore of the rotating disc which displaces a portion of metal in the form of an axially extending collar. The shaping roller include various surface configurations for forming any number of various hub shapes. In addition, the spinning process may include the use of more than one shaping roller acting on the annular sheet metal disc at different times.

6 Claims, 10 Drawing Sheets

INTERNAL SPUN HUB AND METHOD OF MAKING SAME

This application claims priority from U.S. provisional application Ser. No. 60/160,253 filed Oct. 19, 1999.

BACKGROUND OF THE INVENTION

The invention relates to a hub or pulley of sheet metal made by spin-roll forming, but more particularly, the invention relates to a pulley having a hub spun-roll formed by radially displacing an annular sheet metal disc outward from a bore.

Machined hubs formed from bar stock are sometimes attached to webs and rims formed of sheet metal to make pulleys. A sheet metal web (or disc) and rim are attached to a machined hub be welding, brazing, fasteners, or adhesion. A machined hub may provide complicated shapes such as a closed bore but it introduces the attendant problems of weight, cost and process complexities associated with axially alignment during assembly of the hub to the rim.

Hubs or pulleys of sheet metal may be shaped by press forming using a series of dies or spin-forming using mandrels and rollers or a combination thereof. For example, a pulley with an integral hub that is press formed is disclosed in U.S. Pat. No. 5,441,456 with a stepped bore in FIG. 5, and a bore with spline receiving grooves in FIG. 8. Belt receiving grooves are spin formed in the rim of the pulley. Another pulley with an integral hub is shown in U.S. Pat. No. 4,824,422.

German Patent No. 4,444,526 discloses a method of shaping a hub by spin forming where a shaping roller is pressed against a side of a spinning annular disc of sheet metal that is supported at an opposite side with a head stock mandrel. The shaping roller is moved progressively radially inwardly against the side of the rotating disc which displaces a portion of metal while thinning part of the disc and forming a sidewall having a thickness that is less than the original sheet metal thickness. An annular wave is formed as metal is displaced and which progressively, axially extends. A shaping roller presses the annularly displaced metal against a mandrel while simultaneously forming a hub integral to the disc. The problem with such hubs is that the formed hub sidewall is formed from one side of the hub only. In addition, in order to form such hubs, a greater amount of metal is displaced, as such, hubs requiring a smaller outside diameter are more difficult to form.

SUMMARY OF THE INVENTION

A hub having a bore, in accordance with the present invention, is spun-roll formed of a portion of an annular sheet metal disc. The hub is formed by radially displacing a portion of the annular sheet disc outward from the bore. The so formed hub that is integral to the annular sheet metal disc forms a web having a thickness equivalent to or not less than a thickness of the annular sheet metal disc before formation of the hub. The web may be used to spun-roll form a rim having a belt receiving portion and as such a one-piece spun roll formed pulley. The web may also be used to interconnect to a rim having a belt receiving portion as a separate piece from the hub and web.

During the spinning process, a shaping roller is pressed against a bore of an annular sheet metal disc which is being rotated simultaneously. The shaping roller is moved progressively, radially outward, with or without axial oscillation, against the bore of the rotating disc which displaces a portion of metal in the form of an axially extending collar. The shaping roller include various surface configurations for forming any number of various hub shapes. In addition, the spinning process may include the use of more than one shaping roller acting on the annular sheet metal disc at different times.

An object of the invention is to provide a hub that is spun-roll formed by radially displacing a portion of an annular sheet metal disc outward from a bore. The invention provides an ease of manufacturing by reducing complexities associated with axial alignment. Further, the invention affords the ability to produce smaller compact hub and pulleys.

Another object of the invention is to provide a method of spin forming a hub with an integral web having a thickness which is unchanged after the spin forming process and as such stronger.

These and other objects or advantages of the invention will be apparent after reviewing the drawings and descriptions thereof wherein.

Figure 9:
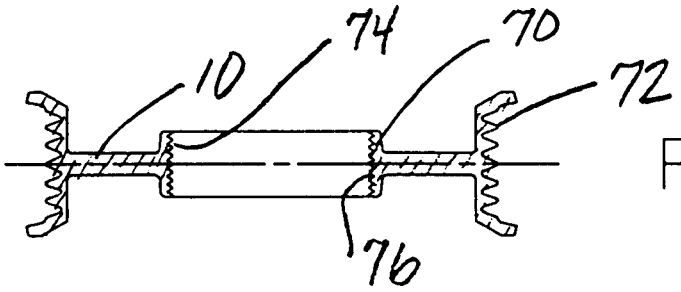
Figure 10:
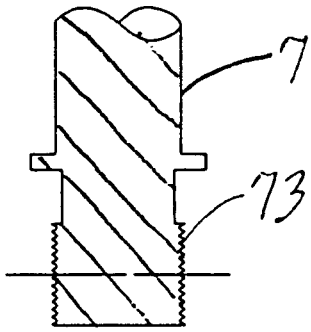
Figure 11:
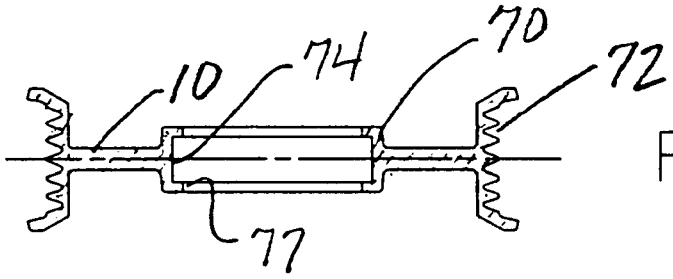
Figure 12:
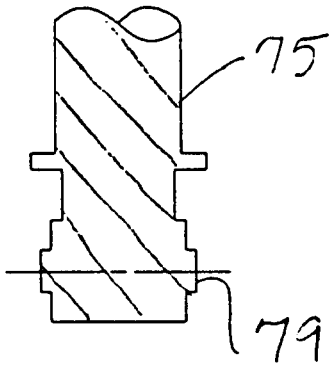
Figures 13, 14, 15:
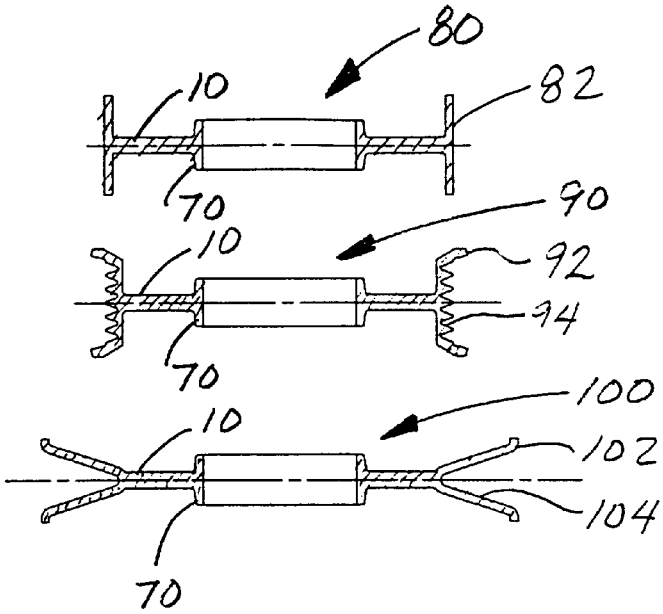

FIGS. 8*a*–8*g* are cross sections along a radial line from the center line of an annular disc showing progressive displacement, including optional operations, of the portion of metal from a portion of the annular disc and the formation of a hub of the invention;

FIG. 9 is a cross sectional view of a hub of the invention having internal threads;

FIG. 10 is a cross sectional view of a shaping roller used for forming the hub shown in FIG. 9;

FIG. 11 is a cross sectional view of a hub of the invention having a closed bore;

FIG. 12 is a cross sectional view of a shaping roller used for forming the hub shown in FIG. 11;

FIG. 13 is a cross sectional view of a flat pulley with a hub of the invention;

FIG. 14 is a cross sectional view of a v-ribbed pulley with a hub of the invention; and FIG. 15 is a cross-sectional view of a v-belt pulley with a hub of the invention.

DESCRIPTION OF THE INVENTION

Referring to FIGS. 1–7, an annular disc 10 of sheet metal having a bore 26 is positioned for working with spin-roll forming machinery shown generally at 12 that includes head stock tooling 14, a shaping roller 16, and a holding tool 18

Figure 1:
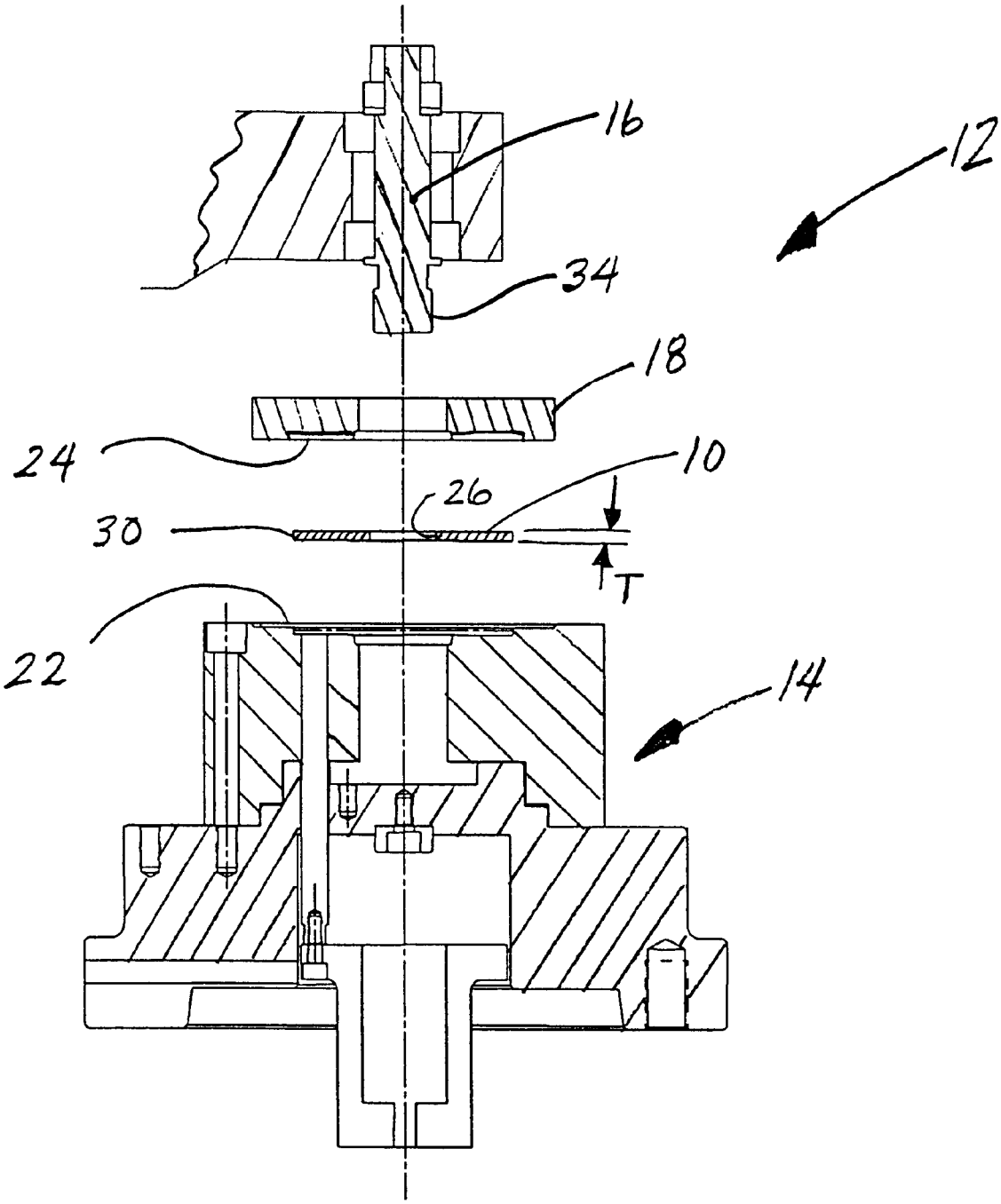
FIG. 1 is a schematic in cross-section illustrating key elements of a spin-roll forming machine and an annular disc positioned in the machine for spin-roll forming.

In FIG. 1, the head stock 14 has a cylindrical recess 22 sized to receive the external diameter 30 of the disc 10 and where the recess has a depth that is less than the thickness T of the disc 10. The holding tool 18 includes a corresponding cylindrical recess 24 for receiving a portion of the external diameter 30 of the disc 10 and where the holding tool recess has a depth that is less than the thickness T of the disc 10.

The shaping roller 16 has an external profile surface 34 corresponding to the desired material flow operation. In FIG. 1, the shaping roller 16 includes an external profile surface 34 for gathering and flattening the disc 10 material.

Figure 2:
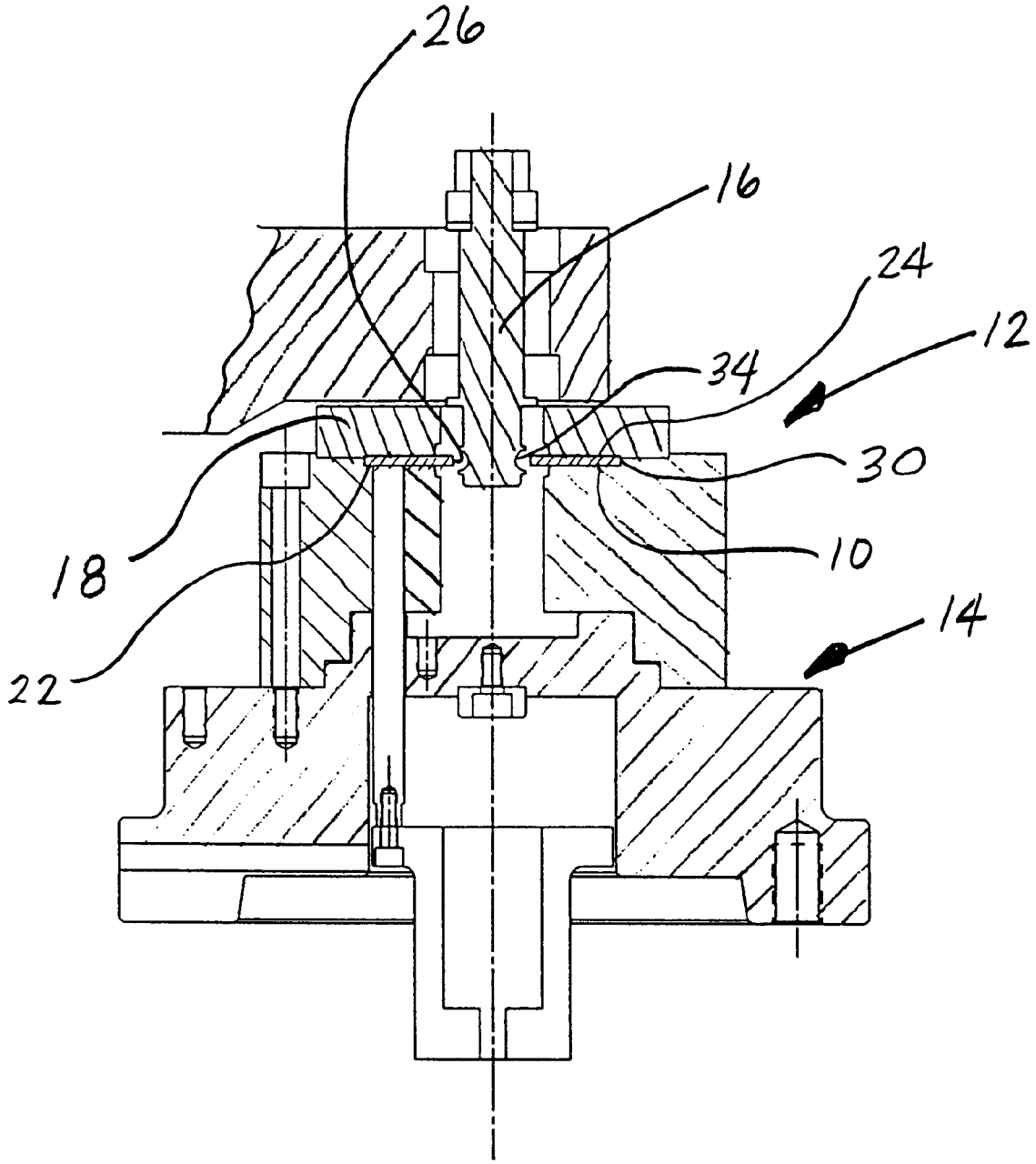
FIG. 2 is a view similar to FIG. 1 but showing the machine and disc positioned near the start of spin-roll forming.

FIG. 2 shows the annular disc 10 inserted in the spin-roll forming machinery 12 prior to the forming operation. The disc 10 is clamped inside the holding tool 18 recess 24 and the head stock tooling 14 recess 22. The shaping roller 16 is positioned in axial alignment with and inside the bore 26. The head stock tooling 14 is rotated a predetermined amount of revolutions per minute.

Figure 3:
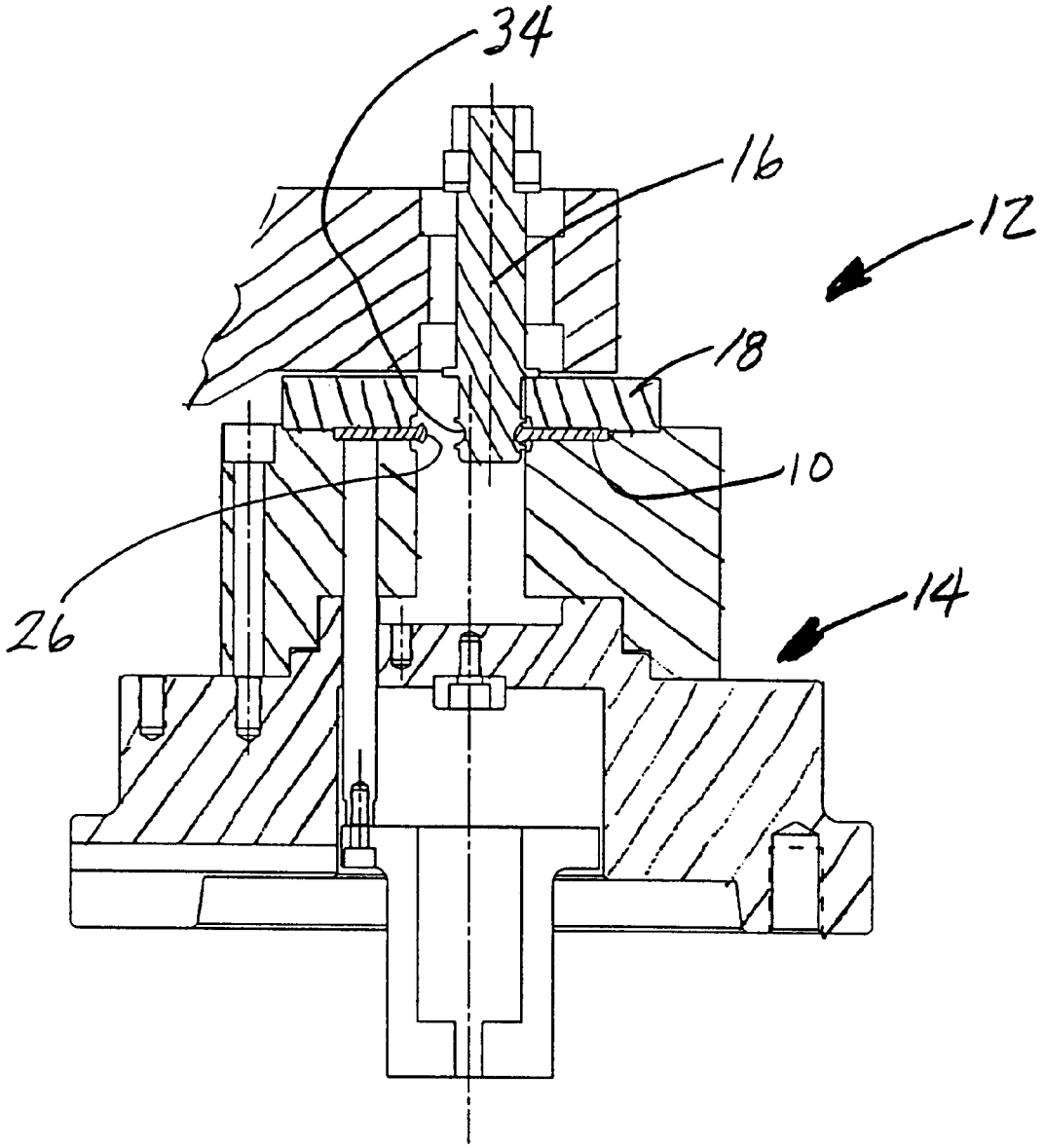
FIG. 3 is a view similar to FIG. 2 but showing a progressive operational step.

FIG. 3 shows the shaping roller 16 moved to a radially outward position so that the external profile surface 34 of the shaping roller 16 is pressed against the bore 26 while the annular sheet metal disc is being rotated. Shaping roller 16 is free to rotate as the disc spins and the shaping roller 16 may also be oscillating along an axis parallel to an axis of the bore 26. The shaping roller 16 initiates displacing a portion of the disc 10 metal from the bore 26 radially outward. The shaping roller 16 radial movement and the external profile surface 34 are correspondingly used to form select bore and hub sizes and shapes.

Figure 4:
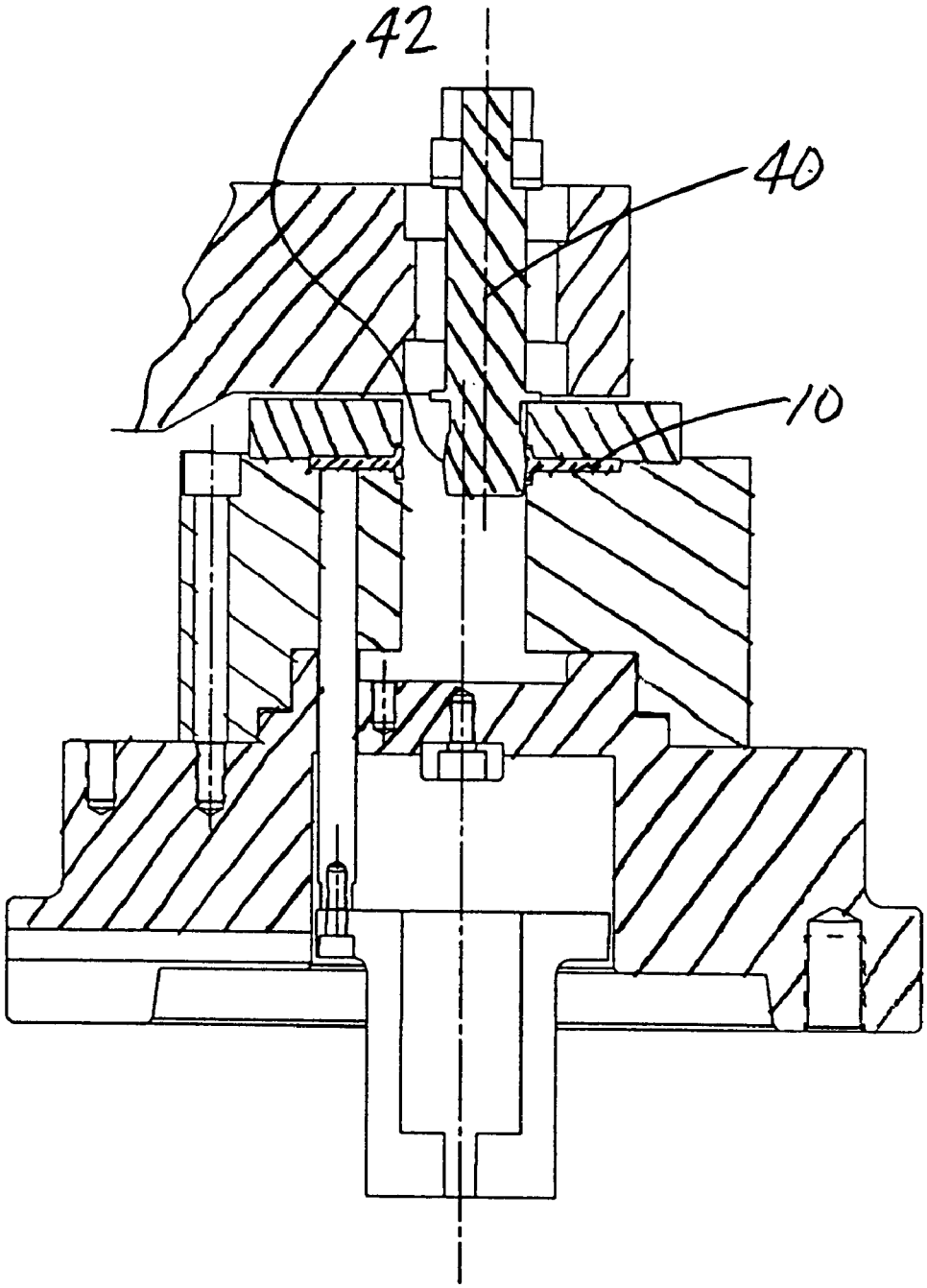
FIG. 4 is a view similar to FIG. 3 but showing an optional progressive operational step.

For example, FIG. 4 shows an optional shaping roller 40 having a convex external profile surface 42 used for gathering the disc 10 metal and splitting the disc 10 metal.

Figure 5:
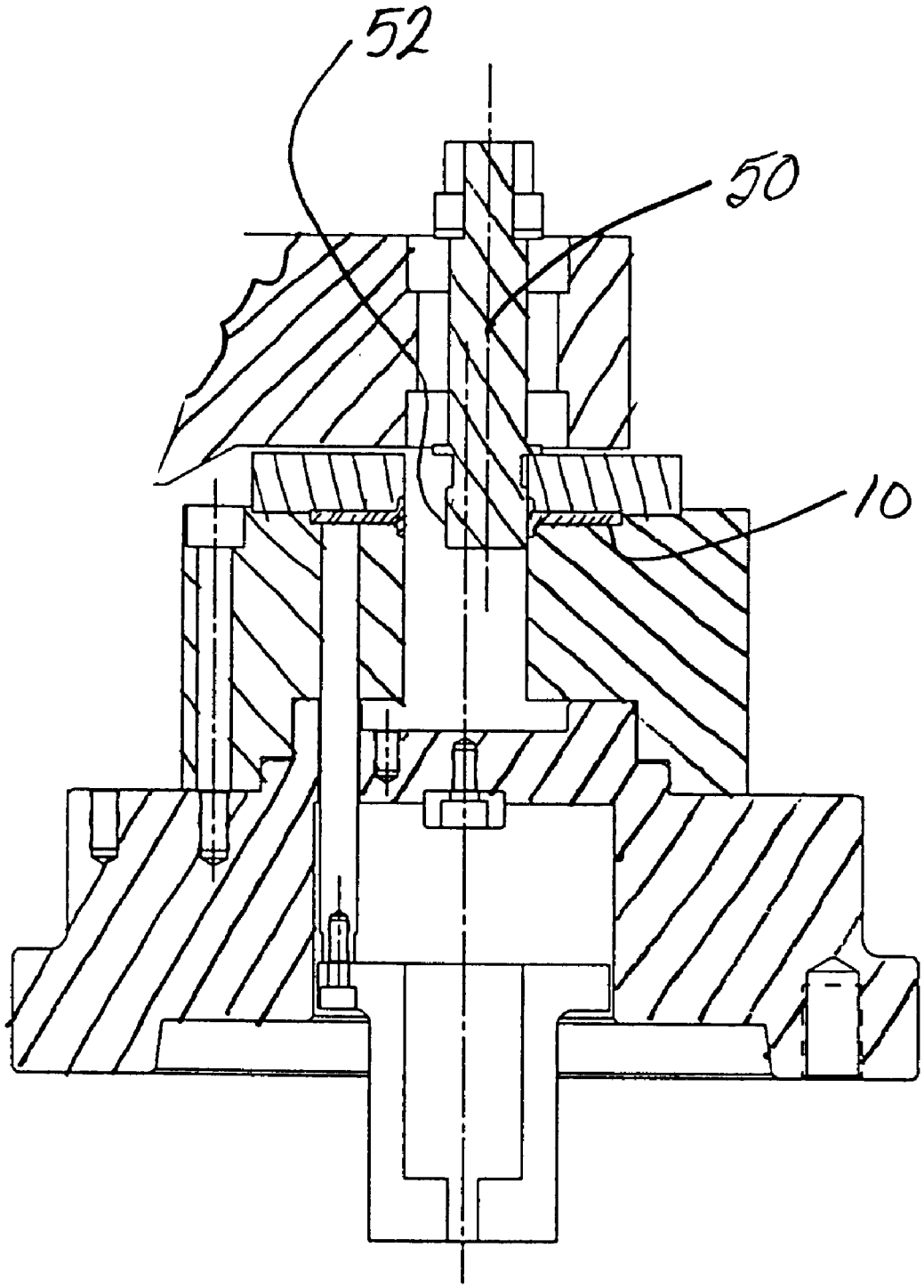
FIG. 5 is a view similar to FIG. 3 but showing an optional progressive operational step.

FIG. 5 shows an optional shaping roller 50 having a flat external profile surface 52 used for gathering and flattening the disc 10 metal.

Figure 6:
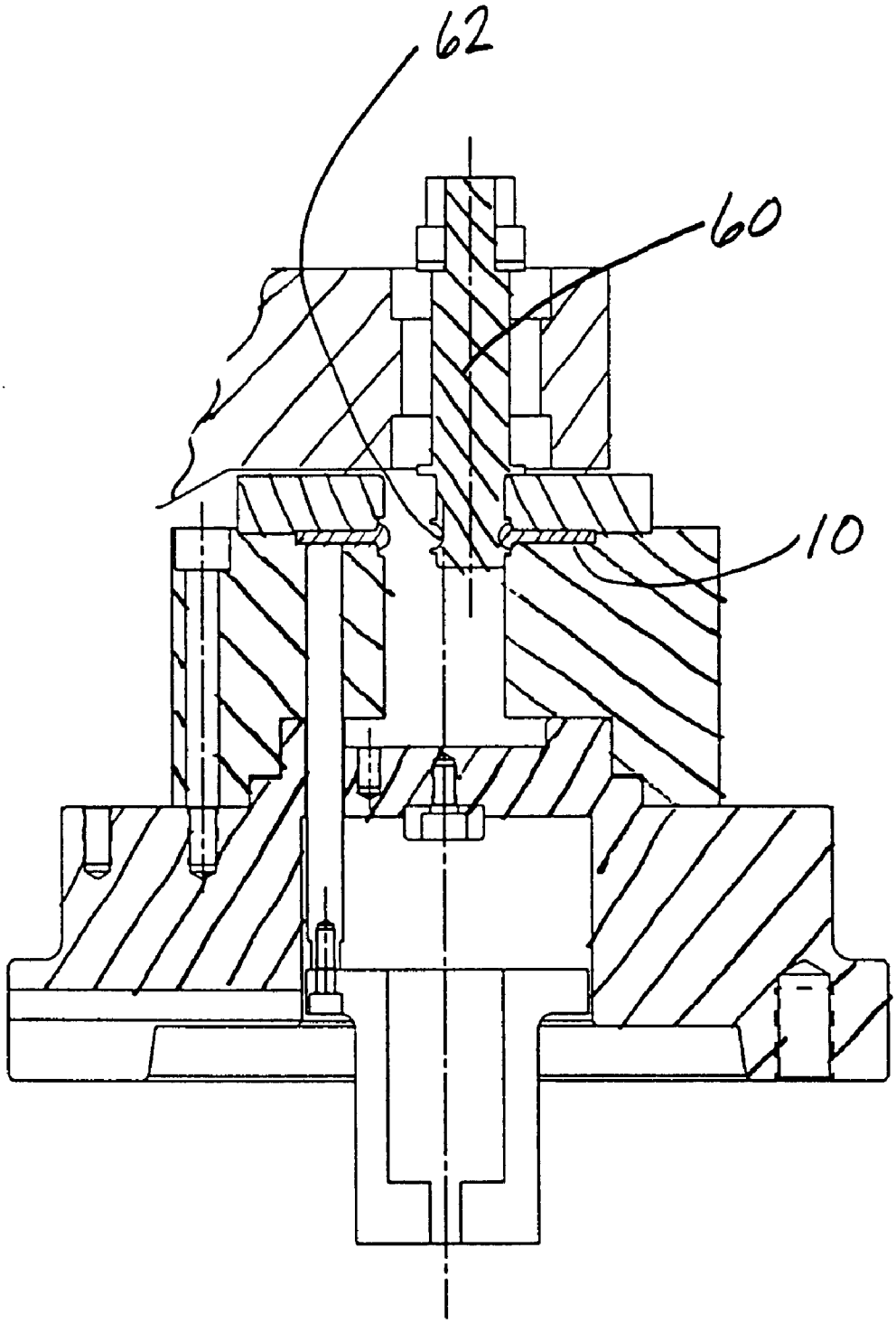
FIG. 6 is a view similar to FIG. 3 but showing an optional progressive operational step.

Similarly, as shown in FIG. 6, an optional shaping roller 60 having a concave external profile surface 62 used for gathering the disc 10 metal.

Figure 7:
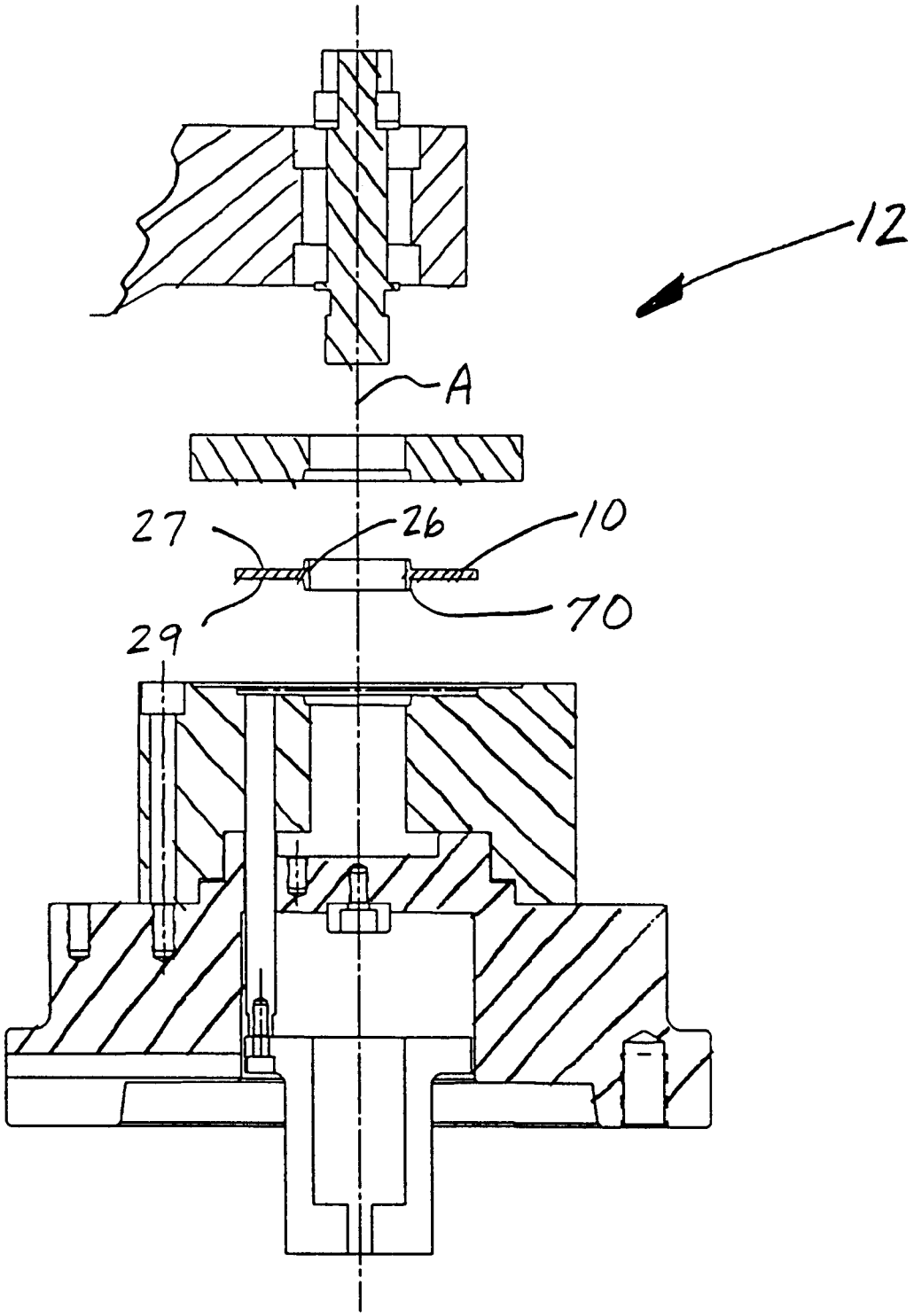
FIG. 7 is a view similar to FIG. 2 but showing a final spin forming step.

FIG. 7 shows the annular sheet metal disc 10 removed from the spin-roll forming machine 12 after forming a hub 70. The hub 70 includes an integral disc or web 10 and a bore 26. The hub 70 extends from a first surface 27 and a second surface 29 of the web 10 in a direction parallel the an axis A of the bore 26.

Figures 8A, 8B, 8C, 8D, 8E, 8F, 8G:
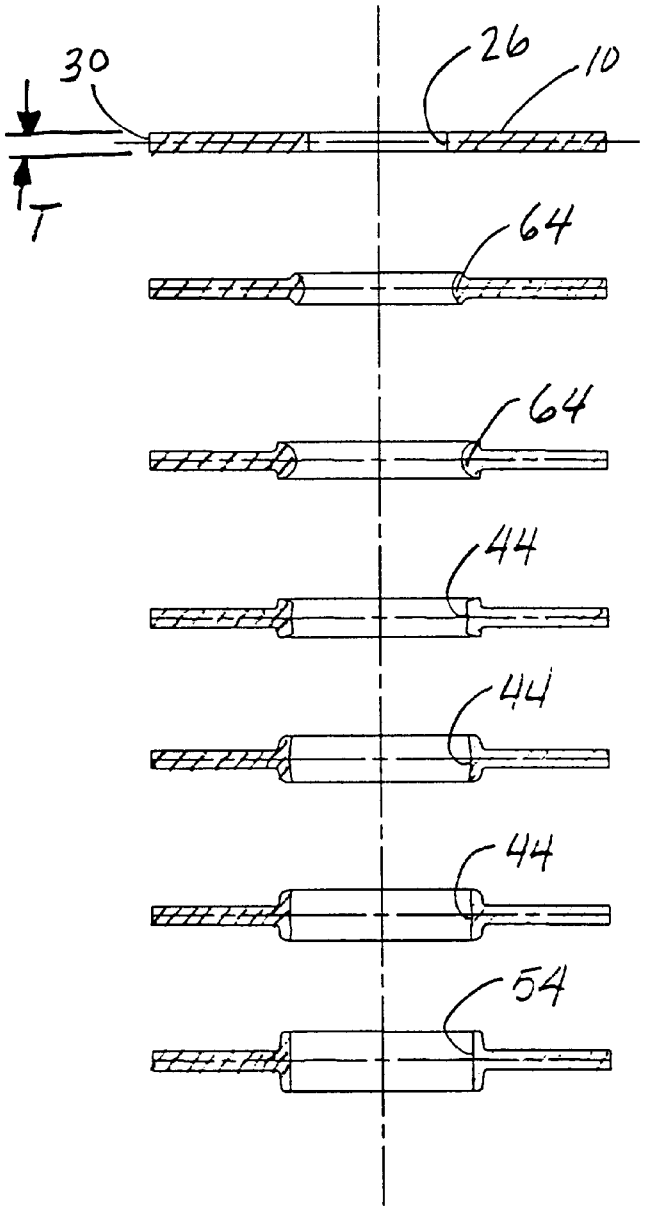

Referring to FIGS. 8*a* through 8*g* illustrates the progressive formation of a hub 50 of the invention including various optional progressive operational steps. FIG. 8*a* shows an annular sheet metal disc 10 with a bore 26 prior to any spin-roll forming. The disc 10 includes an outer diameter 30 and a thickness T.

In some applications, as shown in FIG. 6 a shaping roller 60 having a concave external profile surface 62 is used to gather the disc 10 metal as indicated at 64 in FIGS. 8*b* and 8*c*. As shown in FIG. 4, after gathering, an optional progressive step including the use of a shaping roller 40 having a convex external profile surface 42 may be used to split the disc 10 metal as indicated at 44 in FIGS. 8*d* through 8*f*. As shown in FIG. 5, an optional progressive step including the use of a shaping roller 50 having a flat external profile surface 52 may be used to gather and flatten the disc 10 metal as indicated at 54 in FIG. 8*g*.

Referring to FIG. 9, the hub 70 of the invention having a bore 74, with its integral disc 10 or web and a v-ribbed rim 72 may also be formed including internal threads 76. FIG. 10 shows a shaping roller 71 used for forming the internal threads 76. The shaping roller 71 includes external threads 73.

Referring to FIG. 11, the hub 70 of the invention having a bore 74, with its integral disc 10 or web and a v-ribbed rim 72 may also be formed including a closed bore 77. FIG. 12 shows a shaping roller 75 used for forming the closed bore 77. The shaping roller 75 includes a protruded surface 79.

The hub 70 of the invention with its integral disc 10 or web may be used in conjunction with pulleys as for example, those shown in FIGS. 13–14. Referring to FIG. 13, a cylindrical pulley 80 is illustrated. The outer circumferential edge of disc 10 (or web) is split in known fashion to form an integral, cylindrical rim 82 for receiving a belt (not shown).

A v-ribbed pulley 90 is shown in FIG. 14 where the outer circumferential edge of the disc 10 is split in known fashion to form a rim 92 having a plurality of v-grooves 94 for engaging a v-ribbed belt.

In FIG. 15, a v-belt pulley 100 is shown where the outer circumferential edge of the disc 10 is split in known fashion to form a rim 102 having at least on v-groove 104.

The foregoing detailed description is made for the purpose of illustrating only and is not intended to limit the scope of the claims.

What is claimed is:

1. A method of forming a hub that is spun-roll formed of a portion of an annular sheet metal disc and a bore and wherein the improvement comprises the steps of:

gathering a portion of the annular sheet metal disc from a bore edge thereby forming a circumferentially continuous toroidal form about the bore edge; and radially displacing the portion of the annular sheet metal disc outward from the bore.

2. The method as in claim 1, wherein the disc includes a web integral with a rim having a belt receiving portion.

3. A method of forming a pulley including a hub and a web comprising the steps of:

inserting an annular sheet metal disc having a bore into a spun-roll forming machine;

clamping the annular sheet metal disc to the spun-roll forming machine;

positioning a shaping roller having a concave external profile surface in axial alignment with the bore;

moving the shaping roller into the bore;

rotating the annular sheet metal disc;

moving the shaping roller in a radially outward direction against a disc bore edge a predetermined distance whereby the concave external profile surface gathers sheet metal disc material;

positioning a pulley shaping roller against an outer surface of the web;

moving the pulley shaping roller in a radially inward direction against the web outer surface a predetermined distance in order to displace the material to thereby form a rim having a belt receiving portion.

4. The method as in claim 3, wherein the disc includes a web integral with a rim having a belt receiving portion.

5. The method as in claim 3, wherein the step of gathering sheet metal disc material further comprises the step of:

forming a circumferentially continuous toroidal form about the bore edge.

6. The method as in claim 5 comprising:

forming the gathered sheet metal disc material to form a hub.

* * * * *